United States Patent [19]

Hodges et al.

[11] 4,240,886

[45] Dec. 23, 1980

[54] ELECTROWINNING USING FLUIDIZED BED APPARATUS

[75] Inventors: Donald R. Hodges, Denver; William G. Sherwood, Golden, both of Colo.; Cvetko Nikolic, Harvey, La.

[73] Assignee: Amax Inc., Greenwich, Conn.

[21] Appl. No.: 12,778

[22] Filed: Feb. 16, 1979

[51] Int. Cl.[3] ..... C25C 1/00; C25C 1/08

[52] U.S. Cl. ..... 204/112; 204/130; 204/222; 204/290 R

[58] Field of Search ..... 204/112, 222, 290 R, 204/130

[56] References Cited

U.S. PATENT DOCUMENTS

| | | | |
|---|---|---|---|
| 3,703,446 | 11/1972 | Haycock et al. | 204/222 |
| 3,941,669 | 3/1976 | Bharucha et al. | 204/222 |
| 3,974,049 | 8/1976 | James et al. | 204/222 |
| 3,988,221 | 10/1976 | Garrett et al. | 204/222 |
| 4,035,278 | 7/1977 | Wilkinson et al. | 204/222 |
| 4,073,702 | 2/1978 | Fleichmann et al. | 204/222 |

*Primary Examiner*—R. L. Andrews

*Attorney, Agent, or Firm*—Michael A. Ciomek; Eugene J. Kalil

[57] ABSTRACT

A fluid bed electrolysis system and process are provided for efficiently removing electroplatable metal ions from an electrolyte, the system utilizing a cell having an axially disposed anode surrounded by a cathode, the anode being partitioned from the cathode by a porous diaphragm. The porous diaphragm defines an anode chamber surrounded by an annular cathode chamber, the annular cathode chamber being adapted to support a fluidizable cathode bed of electrically conductive particulate material, the system having electrolyte circulating means for recirculating electrolyte through said cell and for maintaining said electrically conductive particulate material in an electrochemically active fluidized state, including means for disengaging gas bubbles from said circulated solution formed during electrolysis.

6 Claims, 11 Drawing Figures

ELECTROWINNING USING FLUIDIZED BED APPARATUS

This invention relates to a fluid bed electrolysis system and, in particular, to a cell design and to a process for recovering metals from electrolytes by fluid bed electrolysis, such as dilute electrolyte solutions.

BACKGROUND OF THE INVENTION

The use of electrochemical processes in extractive metallurgy is constantly growing because of the relative stability of electrical energy costs and an increasing application of hydrometallurgical processes for environmental reasons. Electrowinning and electro-refining processes using plate electrodes have been in operation for many decades. However, such processes suffer from capacity limitations. The cell production capacity per unit volume is limited not only by the chemical problems of polarization and the nature of the cathode deposit, but also by the practical problem of electrode surface area per cell unit volume.

Recently, considerable interest has been focused on electrolytic systems using particles that can act either as an extension of the electrode with which they are in contact or behave as an electrode independently, thus achieving a large increase in electrode area per unit cell volume. Such electrodes are particularly useful for processes that can be carried out economically at low current densities, such as electrodeposition of metals from dilute solutions.

One type of electrode is that referred to in the art as a fluid bed electrode (FBE). The term comes from the observation that when a bed of electrically conductive material is fluidized by an upward flow of electrolyte, the bed can be made to function as an electrode by inserting a conductor in the bed (e.g., a cathode) through which an electric current is passed. It is known to employ agitated bed electrodes where the particles are kept in suspension by stirring or by suspension electrodes where the particles are agitated by a vibrating plate or diaphragm. Static beds have been employed; however, such beds tend to cement together during metal deposition and lose their efficiencies.

A fluid bed electrode design that has been proposed is one having a plane parallel configuration comprising a bed of electrically conductive particulate material with an anode disposed above it, the bed being supported on a porous support. In this configuration, the electrolyte is passed through the porous bed support and flows out of the cell at the top. The current feeder for the cathode is located in the bed and is perpendicular to the flow direction of the electrolyte. The flow of current in this type cell is parallel to electrolyte flow.

A disadvantage of this cell using fine nickel powder of approximately 90 microns average size as a cathode is the tendency toward hydrogen gas evolution on the surface of the nickel particles which caused flotation of the particles to the anode surface which in effect caused a change in the position of the anode with respect to the bed. The over-expansion of the bed adversely affected the electrochemical properties of the fluid bed. In the parallel cell configuration, it was difficult to maintain a uniform flow distribution of the electrolyte because of the large cross-sectional area to height ratio of the bed.

Even when the fluidization of the cathode bed was satisfactory, plating tended to occur preferentially on the bed surface facing the anode. Because the cathode feeder was disposed at the bottom, bed heights of only a few centimeters could be tolerated.

Side-by-side electrodes have been proposed comprising a fluid bed electrode with a second electrode inserted into the bed, the second electrode being coated with an insulating material, e.g., polypropylene, of sufficient porosity to provide current flow while avoiding shorting of the cell. Various embodiments of side-by-side electrodes are disclosed in the literature.

In an article entitled "A Preliminary Investigation of Fluidized Bed Electrodes" by J. R. Backhurst et al (Journal of the Electrochemical Society [Electrochemical Technology]; November 1969, pp. 1600–1607), a cell with a side-by-side electrode is disclosed for use in the cathodic reduction of the organic compound nitro benzene sulfonic acid to metanilic acid in aqueous sulfuric acid, a typical cell comprising a cathode bed of copper powder in a cathode chamber isolated by a porous diaphragm which in turn is surrounded by an annular anode (e.g., a lead anode) to provide a cell having a concentric configuration. In cathodically reducing the organic compound, copper-coated glass particles of 450 to 520 micron size were employed, the fluidized bed volume ranging from about 5% to 25% greater than the static bed volume.

In a paper entitled "Feasibility Study On The Electrowinning of Copper With Fluidized-Bed Electrodes" by J. A. E. Wilkinson et al (Institute of Mining and Metallurgy [London]; September, 1972, Vol. 81, pp. C157–C162), a fluidized-bed electrode is disclosed for the electrowinning of copper from leach liquors and other solutions. A side-by-side configuration proposed comprised anode and cathode compartments separated by a non-porous ion exchange membrane, the cathode comprising the fluidized bed. The results indicated that copper could be deposited from dilute solutions.

Another paper of interest is one entitled "The Fluidized Bed in Extractive Metallurgy" by D. S. Flett (Chemistry and Industry; Dec. 16, 1972, #24, pp. 983–988). In this paper, a side-by-side electrode configuration is disclosed comprising a vertical cell in which a fluidized bed is supported vertically on one side of the cell by a membrane and in which a vertically disposed anode is spaced to one side of the membrane-supported fluid bed. The electrolyte is fed from a leach circuit to the fluidized cathode cell for the recovery of metal values therefrom.

A number of cell configurations are considered in the paper entitled "Feasibility Study On The Electrowinning of Copper With Fluidized-Bed Electrodes" by J. A. E. Wilkinson et al (Institute of Mining and Metallurgy [London]; Vol. 82, pp. C119–C125, 1973). One arrangement comprises a side-by-side electrode configuration formed of concentric anode and cathode compartments. In this configuration, the cathode feeder which is tubular is embedded in the bed such that part of the bed is shielded from the anode which is not desirable.

In U.S. Pat. Nos. 3,941,669 and 3,951,773 assigned to Noranda Mines Limited, a fluidized bed electrode system is disclosed comprising an electrode chamber having a porous bed, a main electrode consisting of a bed of electrically conductive particles, an auxiliary electrode (i.e., an anode) with the surface thereof partially impregnated with a synthetic organic fiber screen cloth so that the auxiliary electrode can be introduced into the fluidized bed without risk of forming a short circuit, a current feeder extending into the bed, means for feeding a fluidizing gas into the bed of particles, and means for feeding solution through the fluidized bed.

U.S. Pat. No. 3,988,221 discloses the use of a cathodic fluid bed for the electrolytic removing of heavy metal ions from solution. The cell employed uses a centrally disposed anode with a permeable coating thereon so that the anode can penetrate the fluid bed without shorting the cell.

A problem encountered in fluid bed electrolysis is the formation of gas bubbles during electrolysis (e.g., the formation of oxygen at the anode in the anode chamber and the formation of hydrogen at the cathode in the cathode chamber) which can have an adverse effect on the fluid bed process unless the gases are removed during circulation of the electrolyte. For example, the rapid release of oxygen in the anode chamber may be sufficient to force the electrolyte out of the anode chamber and affect the efficiency of the cell.

It would be desirable to provide a fluid bed electrode system which overcomes the aforementioned disadvantages and which would be particularly desirable for recovering nickel from laterite leach solutions which normally contain less than about 10 grams per liter (gpl) of nickel and up to about 1 gpl cobalt. It would also be desirable to provide a fluid bed electrolyte system for effecting separation of nickel and cobalt from fairly concentrated nickel solutions, for scavenging nickel and cobalt from ion exchange feed solutions, or even to remove impurities from nickel leach solutions, such as Cu, Cd, Zn, and the like.

OBJECTS OF THE INVENTION

It is an object of the invention to provide an improved fluid bed electrolysis system.

Another object is to provide a fluid bed electrolysis cell having particular use in the recovery of metals from dilute solutions.

A further object is to provide an improved process for removing metal values from solutions using a fluid bed electrolysis system.

These and other objects will more clearly appear from the following disclosure and the accompanying drawing, wherein.

STATEMENT OF THE INVENTION

One embodiment of the invention is directed to the use of a fluid bed electrolysis cell in a fluid bed electrolysis system comprising an axially disposed anode surrounded by a cathode, the anode being separated by an anode chamber from said cathode by a partition in the form of a porous diaphragm. The anode chamber is surrounded by an annular cathode chamber, the annular cathode chamber being adapted to support a fluidizable cathode bed of electrically conductive particulate material, such as pelletized nickel, copper or other metals, or non-conductive particles coated with a metal, the particle size of the particulate material being less than the size of openings in the anode diaphragm. The cell system has means for continuously feeding electrolyte into the cathode and anode chambers, the electrolyte containing at least one electroplatable metal ion. The feed rate of the electrolyte is controlled to maintain the bed of particulate material in an electro-chemically active fluidized state and to assure removal of electrolytically produced gas bubbles. In other words, the bed must not be so fluidized that the particles thereof lose their cathodic coupling with the cathode surrounding the bed.

An advantage of the foregoing system is that copper can be quantitatively removed from very dilute solutions. Another advantage is that cobalt can be separated from nickel in the presence of high nickel concentrations over a wide range of electrolyte compositions.

Plating can be achieved in nickel laterite leach solutions, despite the unfavorable nickel to hydrogen ion concentration ratio. Moreover, impurities which generally appear in leach solutions, such as Cu, Cd and Zn, can be quantitatively removed at the fluidized cathode in the presence of over 60 gpl nickel.

Figure 1:
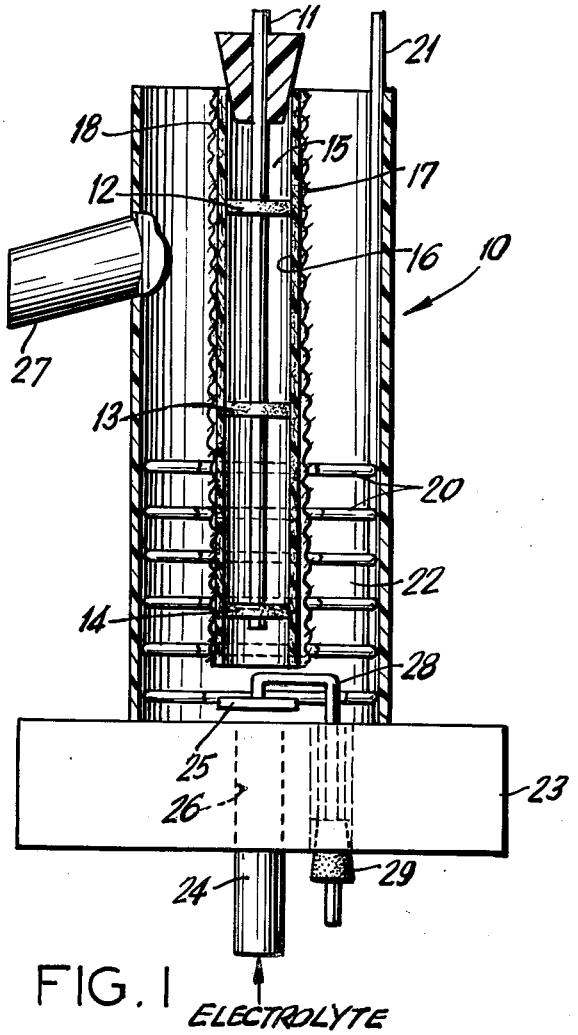
FIG. 1 is one embodiment of a fluid bed cell which may be employed to carry out the invention.

One embodiment of a fluid bed electrolysis cell for use in the system is illustrated in FIG. 1, the cell being designated generally by numeral 10. The cell comprises an anode 11 axially disposed in the cell by rubber anode spacers 12, 13 and 14, the anode being enclosed within an anode chamber 15 surrounded by a partition 16 in the form of a porous diaphragm comprising a perforated diaphragm support 17 of polyvinyl chloride (PVC) with a filter cloth 18, e.g., of nylon, superimposed on the perforated PVC support.

Surrounding the anode chamber is a cathode comprising spaced cathode rings 20 supported by cathode feeder 21. Thus, an annular cathode chamber 22 is provided which is separated from the anode chamber, the chamber being adapted to support a fluidized bed (note FIG. 3) of electrically conductive particulate material.

The cell is supported on a base plate 23 which has an electrolyte inlet at 24 for flowing electrolyte through the cell. A flow distribution or deflection plate 25 is provided which is supported over the electrolyte flow of conduit 26 to distribute the flow of electrolyte throughout the cross-section of the annular cathode chamber, the electrolyte entering the anode chamber by passage through the porous diaphragm 16, the electrolyte leaving the cell at exit 27. The deflection plate 25 is supported via an overhang element 28 which is anchored to the base plate by means of stopper 29.

The cell is electrically activated by means of anode feeder 11 and cathode feeder 21. The anode may be comprised of a silver-lead alloy in the form of a pair of twisted 14 gauge wires, the cathode in one embodiment being formed of evenly spaced copper rings (e.g., 1.5 cm apart) of 16 gauge wire soldered to cathode feeder 21.

A cell which has been employed in tests had the following dimensions. The perforated PVC tube had a diameter of about 2.5 cm (approximately one inch). The anode was spaced from the cathode feeder on the order of 5 centimeters, thereby providing relatively uniform current distribution throughout the fluid bed, regardless of bed height. Uniform electrolyte flow distribution was maintained by means of distribution plate 25 which deflects the flow of electrolyte radially and upwardly through the cell. As a result of tests conducted with the foregoing type of cell, particularly in the electrowinning of copper, and observations made with other fluid bed electrolysis systems, further work led to the system shown schematically in FIG. 2.

Figure 2:
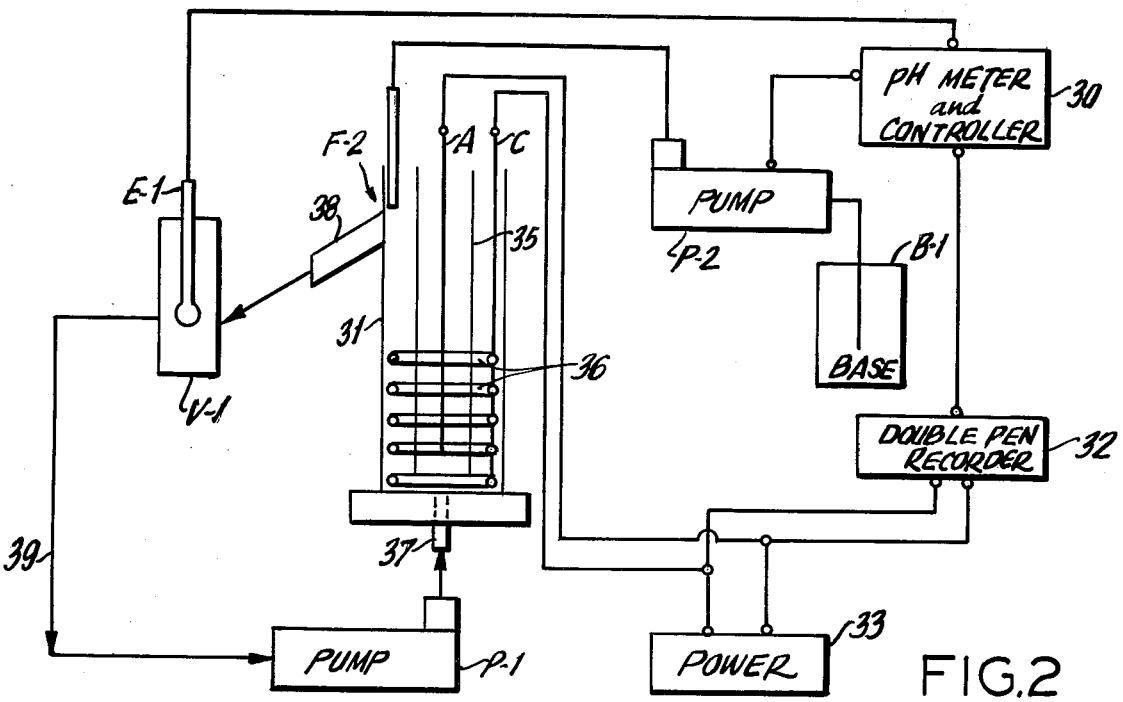
FIG. 2 is one embodiment of a fluid bed electrolysis system for carrying out the process of the invention.

Referring to FIG. 2, pump P-1, which has a flow capacity of 8 liters/minute, is used for electrolyte circulation. A pH probe E-1 is provided. Vessel V-1 isolates the pH probe (E-1) from the electric field in the cell, and, moreover, promotes mixing of the electrolyte and the base (B-1) used for pH control. The base may advantageously be a slurry of magnesium hydroxide. Probe E-1 provides input to the pH meter and controller 30 to feed base from pump P-2 into the electrolyte at point F-2 of cell 31. The pH value is recorded using one channel of a double pen recorder 32. The second channel records the cell voltage, measured across the power supply 33, which is operated at constant current. The cell contains sufficient copper particles (800 microns average size) to provide 2 square meters ($M^2$) of cathode area, and the total circulating electrolyte volume is 1.2 to 1.5 liters. The foregoing cathode area provided by the particles corresponds to about 2,375 grams by weight of the bed.

Anode feeder A and cathode feeder C of the cell (supported by means not shown) are coupled across power supply 33 at the proper voltage and current supply. Anode feeder A is surrounded by a porous diaphragm 35 (which defines the anode chamber) which in turn is surrounded by cathode ring members 36 as in FIG. 1.

The electrolyte is fed by means of pump P-1 into cell inlet 37 and leaves at exit 38 of the cell and is recirculated via line 39 back to pump P-1. The pump may have a pressure-actuated transducer means associated therewith for shutting off the pump and the power when the pressure falls below a predetermined value. The fluidized bed is maintained substantially within the confines of cathode rings 36 in the annular cathode chamber between the anode chamber and the cathode. The electrolyte free of cathode particles enters the anode chamber through the porous diaphragm.

The porous diaphragm should have a large exposed area. The exposed area (the porosity) should range from about 5 to 30% of the total surface area of the diaphragm and, more preferably, range from about 10 to 25% of the total area, so long as the openings are less in size than the average particle size of the cathode particles.

The average particle size of the cathode particles should preferably be over about 100 mesh in size (Tyler Seive Size), for example, over about 150 microns. It is preferred that the average particle size be at least about 35 mesh in size (about 500 microns) and range up to about 10 mesh average size (about 2000 microns). The optimum size preferably varies inversely with the density of the cathode particles.

The volume of the cathode bed in the fluidized state (bed expansion) should be that volume which will assure electro-chemical activity of the bed to pass current. For example, the volume of the fluidized bed should be at least about 5% greater than the volume of the bed at a state of rest (static volume) and range up to about 20% greater than the static volume, depending upon the average particle size of the electrically conductive particles. In addition to elemental powders, or alloy powders, the electrically conductive particles may comprise metal coated ceramic particles, or other metal coated non-conductive particles. The fluidized volume may preferably range from about 8% to 15% greater than the static bed volume.

The ability of ensuring uniform fluidization and of controlling bed expansion provides good current efficiency for reducing nickel concentration to low levels (e.g., to less than about 6 ppm). The same cell design can be used to reduce copper concentration to less than 1 ppm. Apparently, neither lower limit is attainable in conventional cells.

Figure 6:
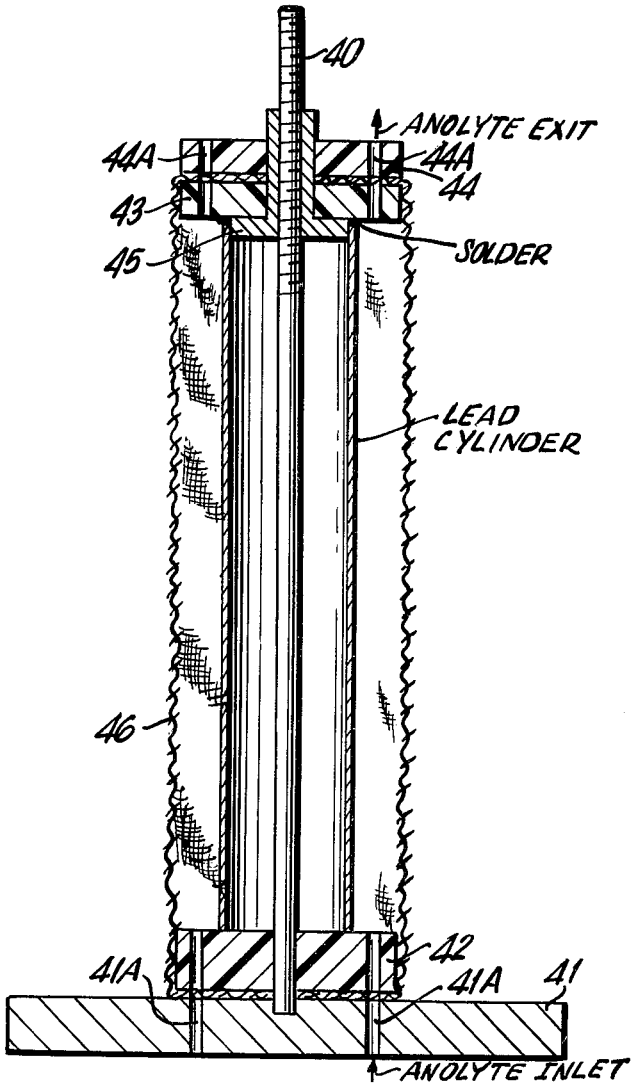
FIG. 6 is an embodiment of an anode surrounded by a porous diaphragm held under tension by tightening means.

Anode chambers are generally made of rigid porous columns rather than from flexible material. The rigid porous material is limited in the amount of porosity it can provide. Thus, while the porous diaphragm shown in FIG. 1 is rigid (perforated PVC tubing covered with a filter cloth), it is preferred to use a more flexible diaphragm made of tensioned filter cloth. Such a diaphragm is shown in FIG. 6 comprising an anode 40 in the form of a threaded titanium rod mounted to flow distribution or deflection plate 41.

The anode 40 is provided with an axially mounted thick Teflon (Registered Trademark) washer 42 fixed at its bottom end and two gripping Teflon washers 43, 44 at its top mounted on a threaded titanium nut or bushing 45, the bushing being threaded to the titanium and soldered to the lead portion of the anode. A sleeve of filter cloth 46 is tension mounted between the upper and lower Teflon washers as shown, washers 43, 44 gripping the end of the sleeve between them, the bottom end of the sleeve being fastened to Teflon washer 42. Tension is applied longitudinally of the sleeve by simply turning the titanium nut or bushing, causing it to move upward along the threaded anode.

The advantage of the foregoing diaphragm is that it provides a flexible anode chamber and also assures high surface exposure of the diaphragm (open spaces) ranging upwards of about 30% of the total area of the diaphragm, e.g., ranging from about 10% to 25% surface exposure. The tension adjustment for the sleeve permits use of inexpensive filter cloth materials for the diaphragm as opposed to porous ceramic or rigid polymeric material (e.g., PVC) used previously. The use of a filter cloth per se as the diaphragm is shown in the cell of FIG. 3, the tensioning means being omitted for purposes of clarity.

Figure 3:
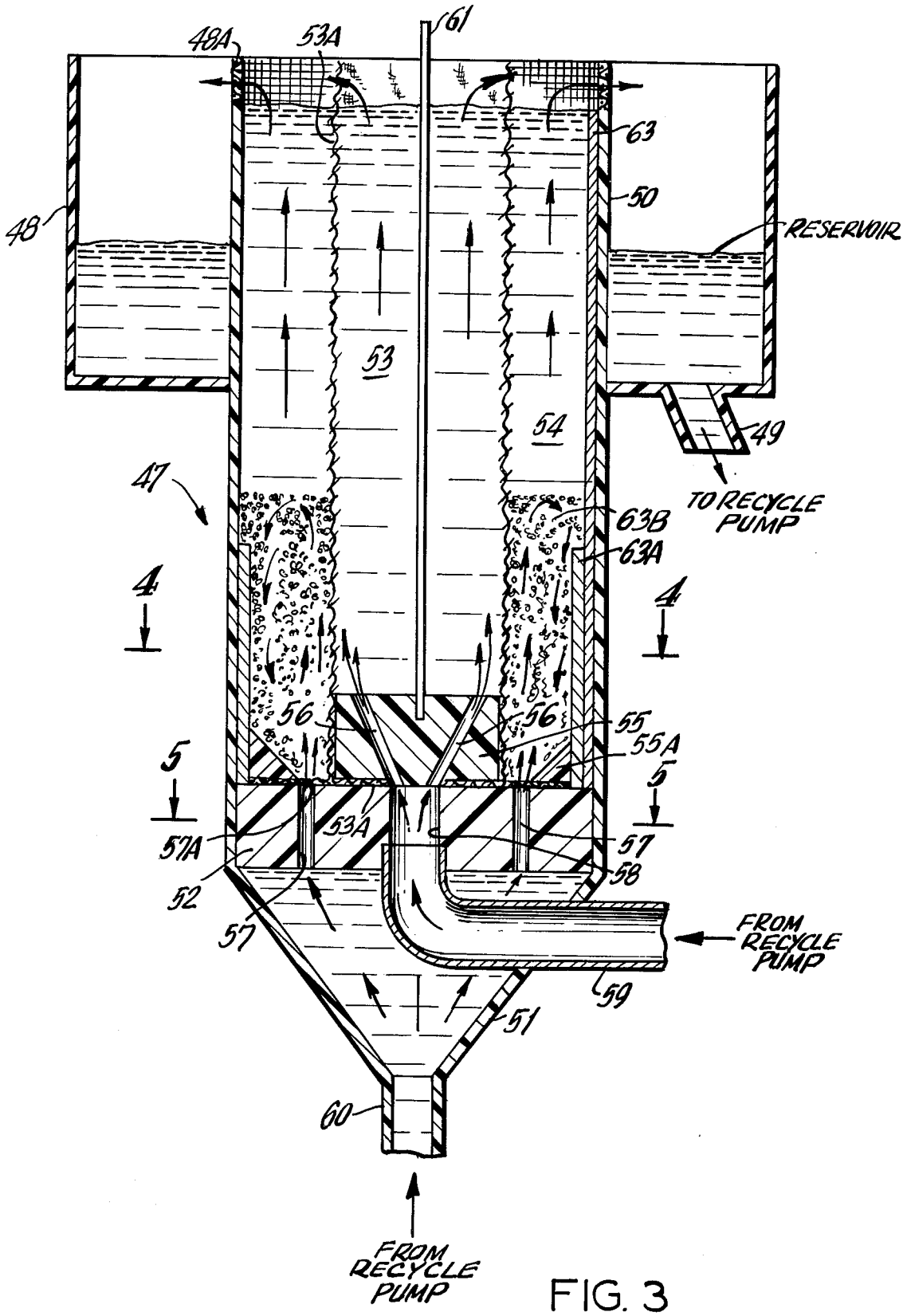
FIG. 3 is another embodiment of a fluid bed electrolysis cell for carrying out the invention.

The embodiment shown in FIG. 3 illustrates the concept of passing the electrolyte directly through the anode chamber as well as through the annular cathode chamber. This is advantageous as it removes the oxygen which deposits at the anode from the cell during circulation of the electrolyte which overflows into a basin in which the gas can disengage itself from the solution before recycle.

Referring to FIG. 3, a cell 47 is shown with an overflow dam or basin 48 located at the top thereof into which circulating electrolyte flows for transfer to a recycle pump via exit port 49. An overflow weir 48A in the form of a screen of inert material, e.g., polymeric fibers, such as nylon or polypropylene, is provided at the top of the cell. The cell may be formed of a plexiglass column 50 having a conically shaped bottom or funnel 51 divided from the upper portion of the cell by horizontal partition 52 of plastic, e.g., Teflon. In place of the overflow dam, a solution reservoir may be employed series-connected to the electrolyte flow. Thus, the reservoir can serve as means for disengaging the gas from the solution before recycle.

The cell above the partition is divided into an anode chamber 53 surrounded by porous diaphragm 53A and an annular cathode chamber 54, the anode chamber having an electrolyte distributor plug 55 of non-conductive material, e.g., plastic, such as Teflon, at its bottom with conically arranged distributor holes or ports 56, the plug being axially located relative to partition 52 which in turn has distributor holes or ports 57 arranged in a circle relative to the annular cathode chamber. The ports 57 at the bottom of the cathode chamber are covered by a nylon screen 57A to prevent downward movement of the particles.

A central port 58 is provided in partition 52 for axially feeding electrolyte into anode distributor ports 56, the central port being coupled to electrolyte feed pipe or conduit 59 which receives electrolyte from a recycle pump not shown. The conical bottom 51 in turn has inlet means 60 for receiving electrolyte from the recycle pump for flowing up into the cathode chamber.

A slender anode 61 is shown (suitably supported by means not shown) extending upwardly into the cell from the anode distributor plug 55, the plug being surrounded by a sheath of filter cloth (e.g., woven nylon) in the form of a diaphragm 53A which extends upwardly into the cell and which is held under tension by means not shown similar to the tensioned diaphragm of FIG. 6.

Figure 4:
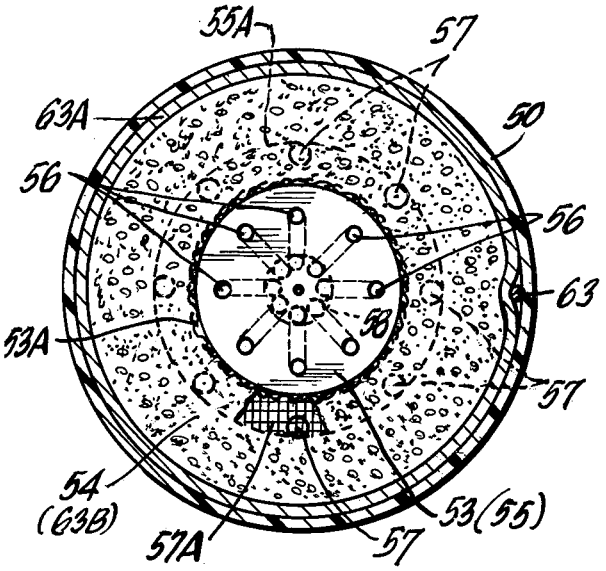
FIG. 4 is a cross-section of the cell of FIG. 3 taken along line 4—4.

A cathode feeder 63 (suitably supported by means not shown) is depicted extending downwardly along the wall of the cell and connected to an annular cathode portion 63A. Thus, an annular cathode chamber is provided between the diaphragm and the annular cathode, the annular chamber being fed with electrolyte through cathode distributor ports 57 arranged in a circle around the annulus of the chamber, as shown in FIG. 4. As will be noted from FIG. 3, the cathode chamber contains a suspension of electrically conductive particles 63B of nickel or copper, or the like.

Figure 5:
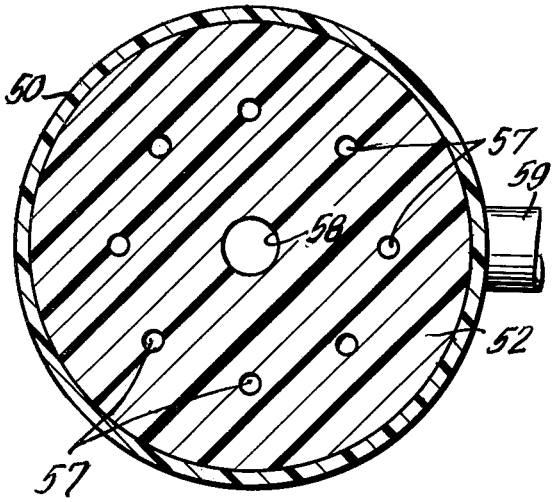
FIG. 5 is a cross-section of the cell of FIG. 3 taken along line 5—5.

FIG. 4 is a cross-section taken along line 4—4 of FIG. 3 showing the cell wall 50, annular cathode 63A, the annular cathode chamber 54 with conductive particles 63B, cathode distributor ports 57, anode distributor ports 56 and the anode segment 62 shown in the center of the cross-section. In FIG. 5 taken along line 5—5 of FIG. 3, the partition 52 is shown within cell wall 50 showing cathode distributor ports 57 arranged in a circle and anode feed port 58 for feeding electrolyte into the distributor ports 56 (FIG. 4) of the anode chamber.

The recycling of the electrolyte to and from the cell will be clearly apparent from the schematic flow sheet of FIG. 2. When the electrolyte containing one or more metal values is fed into the bottom of the cell into the cathode chamber as shown in FIG. 3, the cathode bed is caused to fluidize sufficiently to provide bed suspension and circulation in the cathode chamber as shown, the expansion of the bed under substantially steady state conditions ranging from about 5% to 20% greater than the volume of the bed in a state of rest (that is, the static volume).

Figure 7:
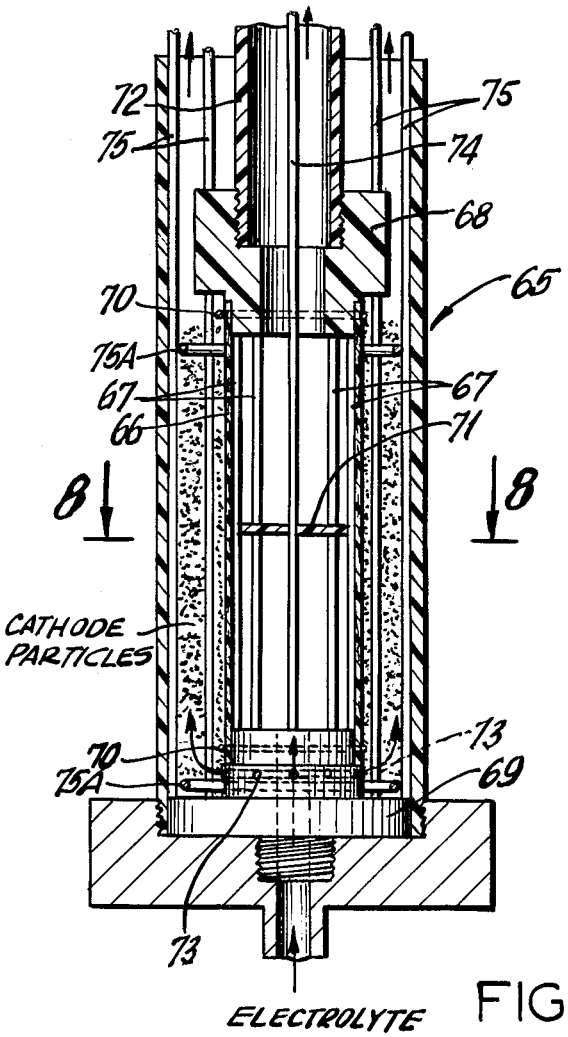
FIGS. 7 and 8 depict another embodiment of a fluid bed electrolysis cell provided by the invention.
Figure 8:
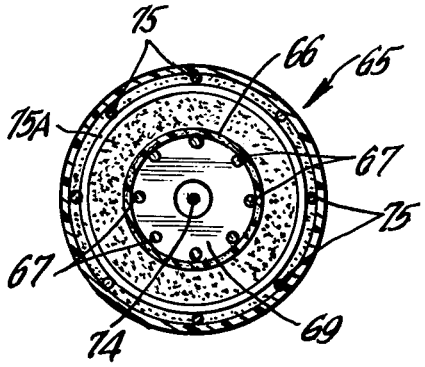

Another embodiment of a fluid bed electrolysis cell is shown in FIG. 7. As in the cells of FIGS. 1 and 3, the cell 65 is divided into two concentric compartments (an anode chamber and an annular cathode chamber) separated by a porous polypropylene diaphragm 66. The diaphragm is supported by eight ⅛" diameter vertical glass rods 67 between an upper anode compartment adaptor 68 and the flow distribution block 69. The diaphragm is a cylindrical tube secured at each end with a neoprene O'ring 70 and a nylon fastener. The small diameter of the glass rods maximizes the exposed anode-cathode interface per unit bed height, increasing the active interfacial area by a factor of 5 over that available with a previously used perforated PVC tube diaphragm support. The anode height (and, therefore, the active bed height) is easily varied with the glass-rod system. Horizontal plexiglass supports 71 prevent the membrane from collapsing and prevent the associated localized high current densities that produce dendritic growth through the membrane.

The upper anode compartment adaptor 68 is threaded to accept a non-porous one-inch threaded PVC tube 72 that directs flow to the top of the cell. The anolyte exits through a screened hole in the upper portion of the tube and is recombined with the recirculating electrolyte.

Electrolyte enters the cell through the center of flow distribution block 69 and is directed into the particulate bed through eight evenly spaced (⅛" diameter) horizontal passages 73. The distributor block can be modified to provide preferential flow, upward, through the anode compartment. This provision is required to obtain higher currents, or to operate with a titanium bed, where only minimal electrolyte flow is necessary to sustain proper bed fluidization. In the absence of preferential anode compartment flow, at low flow rates or high absolute current values, anolyte may be completely displaced from the anode compartment by oxygen produced at the anode surface, and cell resistance becomes substantially infinite.

The recirculating electrolyte exits from the interior cell body into a concentric overflow basin, as in FIG. 3, where gas bubble disengagement occurs. A meshed weir around the center cell body further enhances gas segregation and prevents particles attached to evolved gas bubbles from exiting the cell. This feature is essential to prevent chemical dissolution of deposited metals from the bed particles, in the absence of cathodic protection. Alternatively, a series of similar cells can be used to avoid the necessity for recirculation within a cell.

The anode materials tested were lead-silver or lead-calcium alloys extruded into ¼" diameter rods. The rod 74 is positioned centrally on the flow distributor block, and extends vertically and axially through the diaphragmed anode compartment, where it is centered with horizontal plexiglass supports 71. The rod continues through the PVC tube, and the power supply connection is made at the top of the cell (not shown).

In most tests, the cathode bed consisted of 500 to 700 micron granulated copper particles that are nickel plated in blank tests to eliminate exposed copper surface. Bed particles are maintained in deionized water between tests to minimize surface oxidation. Such oxidation results in long induction periods during which the current efficiency is nearly zero. Titanium particles of similar size have also been tested as bed material.

High current density pretreatment is required to reduce the oxidized titanium surface in order to obtain a sufficiently conductive bed to pre-coat the particles with nickel.

The cathode current feeder 75 consists of eight ⅛" diameter copper tubes soldered to two 2½" diameter copper rings 75A at the top and bottom of the feeder assembly. The height of this portion of the feeders is the same as that of the exposed anode height and the expanded (fluidized) bed height. Two of the feeder tubes extend out of the top of the cell where the power supply connection is made. The extended tubes are electrochemically and chemically shielded with tight-fitting tygon tubing. The horizontal rings previously spaced through the cell as in FIG. 1 at one-inch increments were found not to be necessary to feed current to the bed.

The electro-chemical cell and its relationship to the supporting equipment is similar to that shown schematically in FIG. 2.

As illustrative of the various embodiments of the invention, the following examples are given.

EXAMPLE 1

A test was conducted in a 3-inch diameter cell of the type shown in FIG. 7 with a solution containing 8 gpl $Ni^{+2}$, 60 gpl $Na_2SO_4$, the solution having a pH of about 3.0. Various current loads were employed. The fluid bed contained about 2500 grams of nickel-coated copper particles of average size ranging from about 500 to 700 microns (about 25 to 35 mesh, Tyler Screen) which provided a total surface area of about 2.80 square meters. The fluid bed electrolysis was carried out at various temperatures for eight hours. The results are given in Table 1 below.

TABLE 1

| Current Amps | T, °C. | Current Eff. % | Terminal $Ni^{+2}$, gpl |
|---|---|---|---|
| 10 | Max 36 | 18 | 3.8 |
| 10 | 70 | 29 | .076 |
| 20 | Max 45 | 20 | .070 |
| 20 | 70 | 32 | .048 |
| 30 | Max 59 | 33 | .014 |
| 30 | 70 | 36 | .025 |
| 30 | Max 52 | 27 | .078 |
| 35 | Max 69 | 36 | .11 |
| 35 | 70 | 41 | .094 |
| 40 | 70 | 40 | .050 |

180 gpl $Na_2SO_4$

The data in Table I indicate that increasing the temperature and the current density results in a significant increase in the current efficiency. The difference in efficiency produced by increasing the temperature at a given current density becomes less as the current density increases. This is an artificial effect in that the maximum temperature of uncontrolled tests increases with increasing current density due to resistive heating. No attempt was made to maintain the same low temperature for various current densities.

Although increasing current density typically results in decreased current efficiency in conventional parallel plate electrowinning cells, the opposite effect is observed here, at least in the current ranges investigated. Polarization measurements suggest that a minimum current density is necessary to insure that a sufficient portion of the particulate bed is at the potential necessary to effect reduction of the metal ion of interest. At some limiting current this trend will be reversed, since polarization across the bed and the probability of hydrogen evolution also increases with increasing current. In the cell of FIG. 7 with the radial flow electrolyte distributor, the maximum attainable current is 35 amps.

EXAMPLE 2

Tests were also conducted in a 5" diameter cell. The fluid bed comprising reduced nickel oxide was 12" high, the solution containing 4 gpl $Ni^{+2}$, 60 gpl $Na_2SO_4$ and having a pH of 3.0. The reduced nickel oxide ranged in size from about 600 to 1400 microns, the weight being about 25 lbs. (about 11,300 grs). The volume of the solution was 22 liters, the amount of current being 125 amps. The results obtained are given in Table 2 as follows:

TABLE 2

| Time (min.) | $Ni^{+2}$(gpl) | Cell Voltage |
|---|---|---|
| 0 | 4 | 9.1 |
| 20 | 3.2 | 9.2 |
| 31 | 2.4 | 9.2 |
| 40 | 1.72 | 9.1 |
| 60 | 0.88 | 9.1 |
| 80 | 0.30 | 9.4 |
| 100 | 0.062 | 9.4 |

The current efficiency at 0.062 gpl Ni was 38%. The power consumption was 10.2 KWH/lb of plated metal.

Another test was conducted using a current flow of 250 amps, a fluid bed height of 24", and 24 liters of solution containing 13.4 gpl $Ni^{+2}$ and 60 gpl $Na_2SO_4$.

The results obtained are as follows:

TABLE 3

| Time (min.) | $Ni^{+2}$(gpl) | Cell Voltage |
|---|---|---|
| 0 | 13.4 | 7.9 |
| 27 | 10.4 | 7.9 |
| 45 | 8.8 | 7.8 |
| 60 | 6.8 | 7.8 |
| 75 | 5.0 | 7.9 |
| 90 | 1.76 | 7.95 |
| 108 | 0.82 | 7.8 |

The current efficiency at 0.82 gpl $Ni^{+2}$ was 61% (5.24 KWH/lb metal plated) and at 1.76 gpl $Ni^{+2}$ about 71% (4.35 KWH/lb metal plated).

EXAMPLE 3

A test was conducted in a 3" diameter cell of the type illustrated in FIG. 7 using 2500 grams of nickel particles of size ranging from −35 to +48 mesh (Tyler Screen), the size corresponding to about 250 to 500 microns. Smaller particle sizes generally require a bed restriction device to prevent particles from leaving the cell. The tests were carried out in 4 liters of solution at a current flow of 35 amps and at a temperature of 70° C., the solution containing 17.8 gpl $Ni^{+2}$ and 60 gpl $Na_2SO_4$ (PH=3.0).

The results are given in Table 4 below:

TABLE 4

| Time (min.) | $Ni^{+2}$(gpl) | Cell Voltage |
|---|---|---|
| 0 | 17.8 | 17.5 |
| 15 | 16.8 | 7.5 |
| 30 | 14.8 | 7.5 |
| 45 | 14.0 | 7.3 |
| 60 | 12.6 | 7.6 |
| 90 | 9.4 | 7.3 |
| 120 | 7.6 | 7.1 |

The current efficiency at 7.6 gpl $Ni^{+2}$ was 52.9%, the power consumed being 5.69 KWH/lb of metal deposited.

EXAMPLE 4

Further to the foregoing examples, several electrolyte compositions and system parameters were examined in the course of testing the fluidized cathode cell of the invention. Since most of the published work with fluidized cathodes has been performed using copper containing electrolytes, solutions of similar composition were evaluated.

Figure 9:
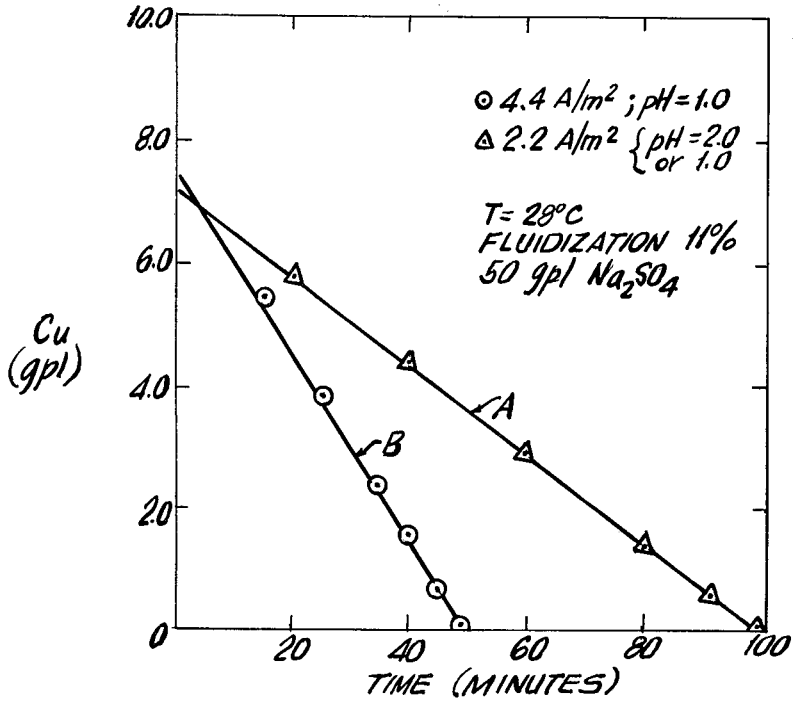
FIG. 9 is a plot showing the removal of copper from solution as a function of time at different current densities.

The rates of deposition on a fluidized cathode, from $CuSO_4$—$Na_2SO_4$ electrolytes at two different current densities and initial pH's, are shown in FIG. 9. The pH was allowed to drop naturally during the course of these tests. The electrolyte flow rate was about 4.8 l/min and the bed expansion was 11%, the bed comprising 2500 grams of copper particles of average size of about 800 microns.

At a current density of 2.22 $A/m^2$ (amps per square meter), identical current efficiencies (80%) were obtained for initial pH's of 2.0 (line A of FIG. 9) and 1.0, when the initial copper concentration was about 7.2 gpl. Increasing the current density to 4.44 $A/m^2$, under otherwise identical conditions, resulted in only a slightly low current efficiency (75%) even at an initial pH of 1.0 (line B). These relatively high efficiencies confirm proper design and operation of the fluidized cathode cell and reflect the wide range of current density—pH conditions over which copper can be efficiently plated. The pH can vary from 0.5 up to below the pH at which copper hydrolyzes from solution.

EXAMPLE 5

Several sulfuric acid solutions corresponding to synthetic leach solutions were tested in the fluidized cathode cell in order to determine its utility for nickel/cobalt separation and for impurity removal (Cu, Cd, Zn). The fluidized bed comprised 2500 grams of nickel-coated copper particles of 500 to 700 microns in size.

Typical results for the Ni/Co separation tests are shown in Table 5. The pH was controlled in the ranges indicated by manual addition of 50% NaOH. The maximum pH does not exceed that pH at which nickel hydrolyzes from solution.

TABLE 5

| Time (min.) | Ni, gpl | Co, gpl | Ni/Co | i, Amps | pH |
|---|---|---|---|---|---|
| 0 | 54. | 1.2 | 46.8 | — | — |
| 60 | 50. | 0.86 | 58 | 4 | 3-6 |
| 120 | 50. | 0.66 | 76 | 4 | 4-2 |
| 180 | 48. | 0.46 | 104 | 4 | 3-2 |
| 240 | 48. | 0.30 | 160 | 4 | 3-2 |
| 300 | 46. | 0.15 | 307 | 4 | 3.5-2 |
| 330 | 42. | 0.086 | 488 | 8 | 4-2 |
| 365 | 37. | 0.034 | 1088 | 12 | 5-2 |

Figure 10:
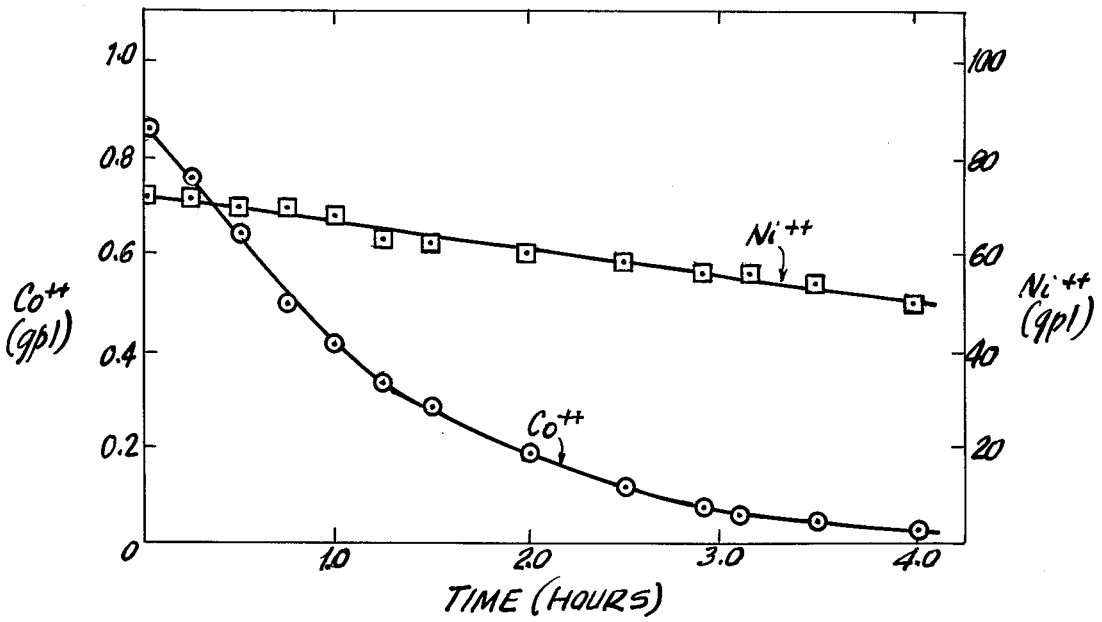
FIG. 10 is a plot depicting nickel/cobalt separation from an ammonia solution.

The net current efficiency during the above test was 45 percent, verifying that Ni and Co can be effectively separated at a fluidized cathode. Although this test was terminated prior to attaining a Ni/Co ratio of 1500:1, this ratio could have been achieved as evidenced by the results of a subsequent test of a nickel-cobalt ammoniacal solution as illustrated by FIG. 10. The current density for this test was 2.22 $A/m^2$ and the pH was 7.6. The initial electrolyte contained 100 gpl $(NH_4)_2SO_4$(2.2 M $NH_3$/M Ni). The final Ni/Co ratio was 1725. These results indicate that Ni/Co separation can be performed even in highly complexing media such as ammonia.

EXAMPLE 6

Impurity removal from synthetic sulfuric acid leach liquor was also examined in the fluidized cathode cell provided by the invention. The results obtained in a typical test are summarized in Table 6. The current density was 2.22 $A/m^2$, the pH was maintained at 5 with $NH_4OH$, and the bed expansion was 11 percent. The fluidized bed was made up of 2500 grams of nickel-coated copper powder of 500 to 700 microns in size.

TABLE 6

| Time (min.) | Ni (gpl) | Cu (ppm) | Cd (ppm) | Zn (ppm) |
|---|---|---|---|---|
| 0 | 66 | 73 | 16 | 12 |
| 15 | 66 | 13 | 16 | 9 |
| 30 | 66 | 10 | 16 | 7 |
| 45 | 66 | 8 | 10.5 | 5 |
| 60 | 64 | 6 | 0.7 | 4 |
| 90 | 64 | 3 | 0.6 | 1 |
| 120 | — | 3 | 0.6 | 1 |

These data indicate that Cu, Cd, and Zn can be reduced to acceptable low levels in the feed solution without significantly lowering the nickel concentration.

EXAMPLE 7

Figure 11:
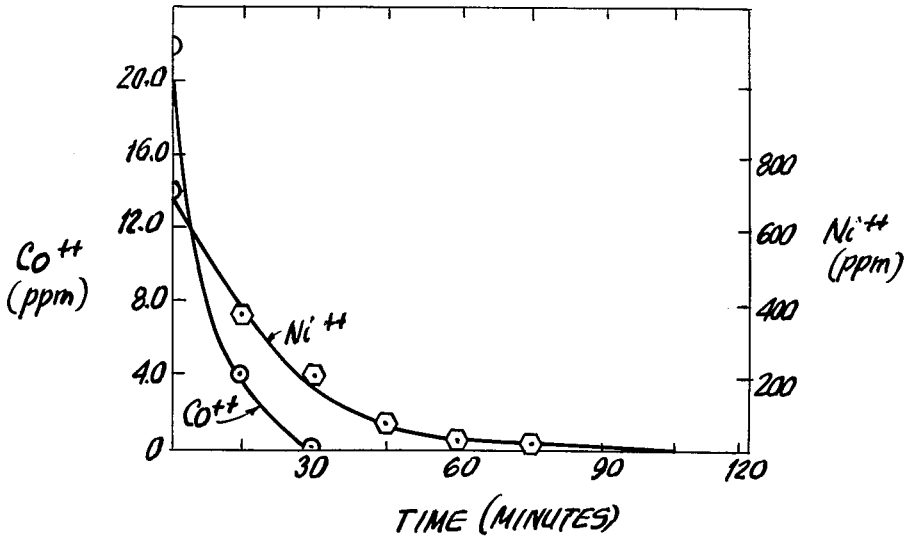
FIG. 11 is a plot showing nickel/cobalt scavenging of a simulated ion-exchange feed solution.

The scavenging of nickel and cobalt from synthetic ion-exchange feed solutions containing 100 gpl $(NH_4)_2SO_4$ was also shown to be feasible in the fluid bed cell. The results obtained at 2.22 $A/m^2$ in the pH range of 8.5 to 9 are shown in FIG. 11. After one hour, the Co concentration was below the detectable limit and the nickel concentration was 30 ppm. The current efficiency after one hour was 15 percent. Originally the solution contained about 14 ppm cobalt and about 1100 ppm nickel. The fluidized bed comprised 2500 grams of nickel-coated copper particles of 500 to 700 microns in size.

Further tests indicated that the relatively low current efficiency obtained with such low concentrations of nickel and cobalt appeared to be due to electro-chemical polarization at the fluidized cathode due to different distances between the anode and fluidized cathode. Such polarization can be minimized by using additional anode feeders at predetermined spacings relative to the fluidized cathode. For example, several anode compartments, each enclosed within its own porous diaphragm, may be employed spaced throughout the cross-section of the fluidized cathode. As will be appreciated, however, the more dilute solutions will generally exhibit a lower current efficiency than a more concentrated solution.

In summary, one embodiment of the invention comprises a process for extracting metal ions from electrolytes using a fluid bed electrolysis cell. The process resides in establishing an electrolyte bath containing at least one metal value in the fluid bed electrolysis cell, the cell comprising an anode disposed axially in the cell within an anode chamber surrounded by a porous diaphragm, and a cathode surrounding the anode chamber, the cathode defining an annular cathode chamber relative to and surrounding the anode chamber containing a fluidizable cathode bed of electrically conductive particulate material. A flow of electrolyte is maintained through the cell by passing the electrolyte axially through the cell starting beneath the fluidizable bed at a rate sufficient to maintain the bed in a fluidized electrochemically active cathodic state at an expanded volume ranging up to about 20% greater than the static bed volume. The cell is electrolytically activated to effect deposition of at least one metal value on the particulate material of the fluidized bed, the electrolysis being continued for a time sufficient to effect the desired amount of metal deposition from the electrolyte.

As will be appreciated, a group of series-connected cells may be employed in which the electrolyte is passed from one cell to another to achieve the same effect as recirculating the electrolyte within the same cell.

A further embodiment resides in a fluid bed electrolysis cell comprising an anode disposed axially in the electrolysis cell within an anode chamber surrounded by a porous diaphragm, and a cathode surrounding the anode chamber, the cathode defining an annular cathode chamber relative to the anode chamber and being adapted to support a fluidizable cathode bed of electrically conductive particulate material. The cell is provided with means for continuously feeding into the cathode chamber and said anode chamber an electrolyte containing at least one electroplatable metal ion, the feed rate of the electrolyte being sufficient to maintain the bed of particulate material in an electro-chemically active fluidized state, a cell exit means being provided for said electrolyte including means for recirculating the electrolyte.

The invention also provides a system in combination with the aforementioned fluid bed electrolysis cell, the system comprising means for determining the change in pH of the electrolyte in said cell, including means for controlling the pH. The system also has means for recording the pH and for recording the cell voltage, including power means for electro-chemically activating the fluid bed electrolysis cell and the recording means.

In operating the fluid bed cell, the amount of particulate material employed should be such to provide an expanded fluid bed uniformly disposed about the anode chamber and a surface area calculated to provide the desired cathode current density falling within the range of about 0.5 to 25 amps per square meter, e.g., 1 to 15 amps per square meter.

The characteristics of each electrolyte can be easily determined as to pH requirements, current density, cell voltage, and the like.

While the fluid bed cells are illustrated herein as being cylindrical, it will be appreciated that rectangular cells are also included within the purview of the invention so long as they contain anode compartments and annular cathode compartments (annular rectangular compartments) that function in the same way as those described herein.

Although the present invention has been described in conjunction with preferred embodiments, it is to be understood that modifications and variations thereto may be resorted to without departing from the spirit and scope of the invention as those skilled in the art will readily understand. Such modifications and variations are considered to be within the purview and scope of the invention and the appended claims.

What is claimed is:

1. A process for extracting metal ions from electrolytes in a fluid bed electrolysis cell which comprises:

establishing an electrolyte bath containing at least one metal value in a fluid bed electrolysis cell comprising, an anode disposed axially in said cell within an anode chamber surrounded by a porous diaphragm, a cathode surrounding the porous diaphragm of said anode chamber, said cathode defining an annular cathode chamber relative to said porous diaphragm and containing a fluidizable cathode bed of electrically conductive particulate material isolated from said anode chamber, maintaining a flow of said electrolyte through said cell by passing said electrolyte axially through said cell beneath said fluidizable cathode bed at a rate to maintain said cathode bed in a fluidized electrochemically active cathodic state, the volume of the electro-chemically active bed ranging from about 5% to 20% greater than its static volume, electrolytically activating said cell to effect deposition of at least one metal value on the particulate material of said fluidized bed during which gas bubbles are formed by electrolysis, causing said flow of electrolyte leaving said cell to collect in a reversoir to permit disengagement and removal of said gas bubbles from said electrolyte, recycling said electrolyte from said reservoir to said cell and through said anode and cathode chambers, and continuing said electrolysis for a time sufficient to effect the desired amount of metal deposition from said electrolyte.

2. The process of claim 1, wherein the fluidized bed volume ranges from about 8% to 15% greater than the static bed volume.

3. The process of claim 1, wherein the electrical conductive particles of the bed have an average size ranging from over 150 microns to about 2000 microns.

4. A continuous method for extracting metal ions from electrolytes in a fluid bed electrolysis cell which comprises:

establishing an electrolyte bath containing at least one metal value in a fluid bed electrolysis cell comprising, an anode disposed axially in said cell within an anode chamber surrounded by a porous diaphragm, a cathode surrounding the porous diaphragm of said anode chamber, said cathode defining an annular cathode chamber relative to said porous diaphragm and containing a fluidizable cathode bed of electrically conductive particulate material, maintaining a continuous flow of said electrolyte through said cell by passing said electrolyte axially through said cell beneath said fluidizable cathode bed and through the cathode and anode chambers at a rate to maintain said cathode bed in a fluidized electrochemically active cathodic state at an expanded volume ranging from about 5% to 20% greater than the volume of said bed at a state of rest, while electrolytically activating said cell to effect deposition of at least one metal value on the particulate material of said fluidized bed during which gas bubbles are formed by electrolysis, causing said flow of electrolyte leaving said cell to collect in a reservoir to permit disengagement and removal of said gas bubbles, continuously withdrawing the electrolyte from said reservoir and recycling it to the cathode and anode chambers through the fluidized cathode bed, continuously monitoring and controlling the pH of the electrolyte at a predetermined value according to the metal or metals being deposited, and continuing said electrolysis for a time sufficient to effect the desired amount of metal deposition from said electrolyte.

5. The continuous process of claim 4, wherein the fluidized bed volume ranges from about 8% to 15% greater than the static bed volume.

6. The process of claim 4, wherein the electrically conductive particles have an average size ranging from over 150 microns to about 2000 microns.

* * * * *